United States Patent [19]

DeWitt

[11] 4,180,210

[45] Dec. 25, 1979

[54] WATER SPRINKLER

[76] Inventor: Robert E. DeWitt, 49 Sherwick Rd., Oswego, Ill. 60543

[21] Appl. No.: 893,268

[22] Filed: Apr. 5, 1978

[51] Int. Cl.[2] ..... B05B 3/00

[52] U.S. Cl. ..... 239/97; 239/383; 239/DIG. 1

[58] Field of Search ..... 239/97, 98, 101, 237, 239/246, 383, 389, DIG. 1

[56] References Cited

U.S. PATENT DOCUMENTS

| | | | |
|---|---|---|---|
| 554,628 | 2/1896 | Rocholl | 239/237 |
| 1,618,538 | 2/1927 | Kittinger | 239/97 |
| 2,090,284 | 8/1937 | Carlson | 239/97 |
| 2,532,356 | 12/1950 | Brown et al. | 239/97 |
| 2,739,839 | 3/1956 | Greener et al. | 239/97 |
| 2,859,064 | 11/1958 | Nelson | 239/97 |
| 4,098,461 | 7/1978 | Weller | 239/383 X |

*Primary Examiner*—John J. Love

*Attorney, Agent, or Firm*—Cook, Wetzel & Egan, Ltd.

[57] ABSTRACT

A water sprinkler is described for developing predetermined but variable patterns of water coverage. The sprinkler includes a plurality of pattern-defining apertures which are contoured in accordance with desired patterns of water coverage to pass varying but predetermined amounts of water as a sprinkler nozzle rotates. A sampling aperture progressively samples the outputs of selected pattern-defining apertures in synchronism with the rotation of the sprinkler nozzle so as to conform the water output of the nozzle to that of the desired pattern of water coverage.

34 Claims, 11 Drawing Figures

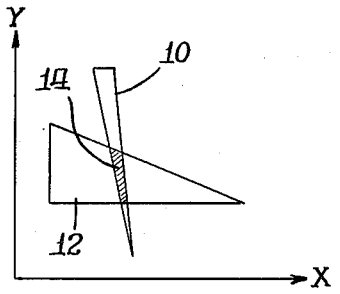
Fig. 1.
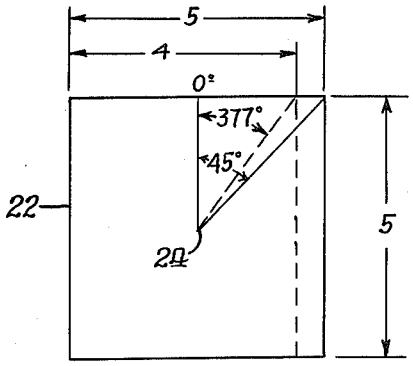
Fig. 3.
Fig. 2.
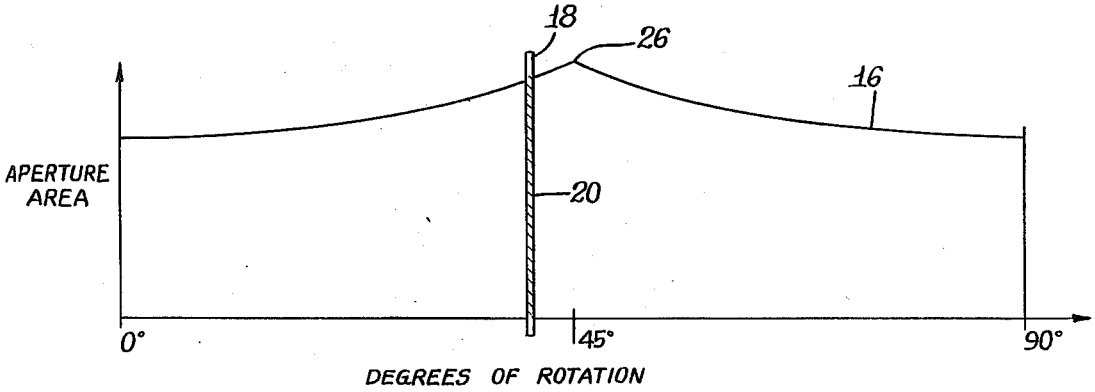
Fig. 4.
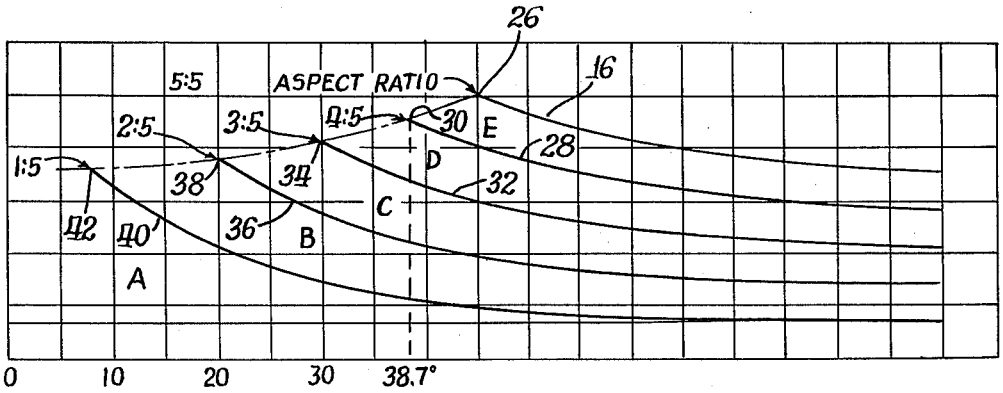

Fig. 5.
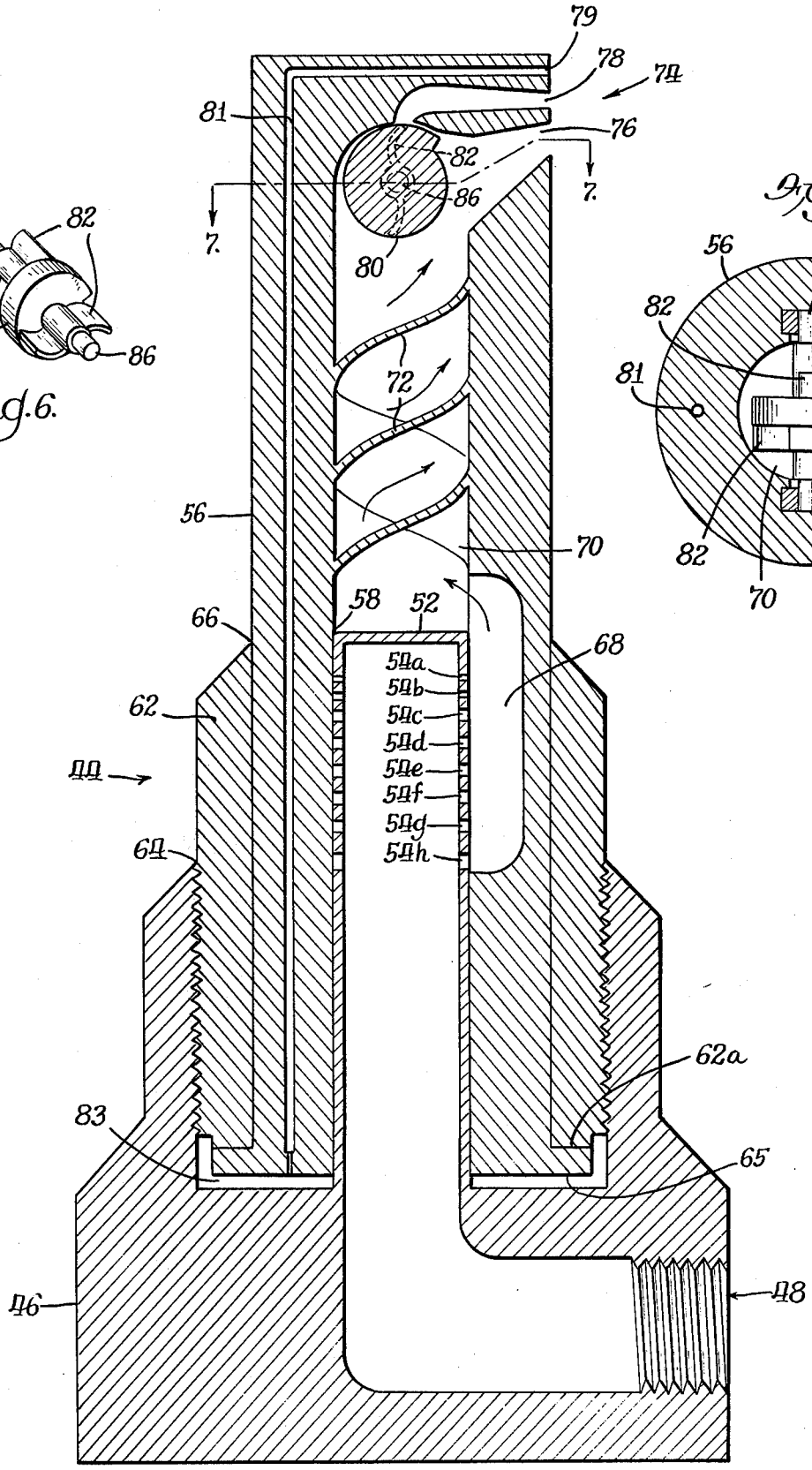
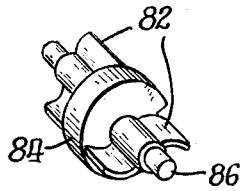
Fig. 6.
Fig. 7.
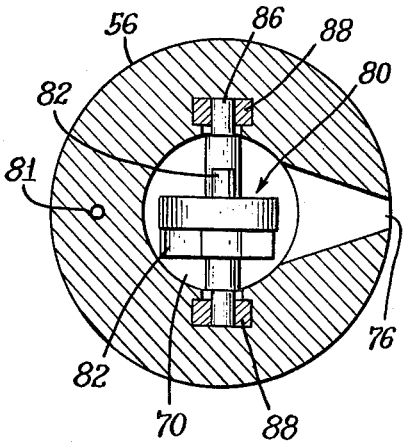

WATER SPRINKLER

BACKGROUND OF THE INVENTION

This invention relates generally to water sprinklers and particularly to water sprinklers for producing a predetermined but variable pattern of water coverage.

In the past, most water sprinklers have been designed to produce but a single pattern of water coverage, generally either circular or rectangular. To conform the pattern of water coverage to the area of a yard, for example, which it is desired to sprinkle, the only variables which can generally be adjusted are the location of the sprinkler and the water pressure received by the sprinkler. However, many yards are irregular in shape, thus making it difficult, if not impossible, to completely conform the pattern of water coverage to the geometry of the yard. Further, in some instances it is desirable to sprinkle only a selected portion of a yard or garden, and yet the pattern of water coverage cannot be accurately conformed to the geometry of the area to be sprinkled. Consequently, either some water must be wasted in covering areas not desired to be sprinkled or the water coverage must be reduced to cover only a portion of the desired area. In either case, the results are not entirely satisfactory.

To generate an irregular pattern of water coverage, it has been proposed to design a water sprinkler whose coverage is defined by a plate having an orifice therein of a geometry corresponding to the geometry of water coverage desired. Thus, the geometry of the orifice defines the pattern of water coverage. See U.S. Pat. No. 4,019,086, for example.

A problem with the type of sprinkler proposed in the aforementioned patent is that the sprinkler must be disassembled each time it is desired to change the pattern of water coverage. That is, if the pattern of water coverage is to be changed from circular to rectangular, for example, a plate having a circular orifice must be removed and replaced by a plate having a rectangular orifice. As a result, it is inconvenient to change the pattern of water coverage.

The above-noted problems associated with prior water sprinklers make it inconvenient, if not impossible, to vary the pattern of water coverage to substantially conform it to a desired pattern. In addition, much water is frequently wasted by sprinkling water outside the desired area of coverage.

OBJECTS OF THE INVENTION

Accordingly, it is an object of this invention to provide an improved water sprinkler.

It is a more particular object of the invention to provide a water sprinkler whose water pattern coverage is easily variable and which can be conformed to many desired coverages.

SUMMARY OF THE INVENTION

Broadly stated, the water sprinkler described herein has an inlet port for receiving water, a rotatable water outlet port for distributing the water in a predetermined pattern of water coverage, and a flow regulator disposed between the inlet port and the outlet port for constraining the flow of water to the outlet port in accordance with the desired pattern of water coverage. In general, the flow regulator includes means defining at least one, and preferably a plurality, of pattern-defining apertures for passing water therethrough, and a sampler defining a pattern-sampling aperture communicating with the pattern-defining aperture. As the outlet port rotates, relative motion between the pattern-defining apertures and the sampling aperture is effected for sampling successive portions of the pattern-defining apertures in synchronism with the rotation of the outlet port.

BRIEF DESCRIPTION OF THE DRAWINGS

The above and other objects of the invention are more particularly set forth in the following detailed description and in the accompanying drawings of which:

FIG. 1 illustrates a pair of relatively movable orifices having a common overlapping area, useful in describing the theory of operation of the invention;

FIG. 2 illustrates another pair of relatively movable orifices having a common overlapping area, useful in describing the way in which a rectangular pattern of water coverage may be obtained;

FIG. 3 illustrates a pair of rectangular water pattern coverages obtainable using the type of orifices shown in FIG. 2;

FIG. 4 illustrates a way in which one of the orifices of FIG. 2 may be segmented to provide rectangular water pattern coverages of various aspect ratios;

FIG. 5 is a sectional view of a water sprinkler according to the invention;

FIG. 6 illustrates a water diffusing wheel for use with the embodiment shown in FIG. 5;

FIG. 7 is a view taken along section lines A—A of FIG. 5;

DESCRIPTION OF THE PREFERRED EMBODIMENT

Figure 8:
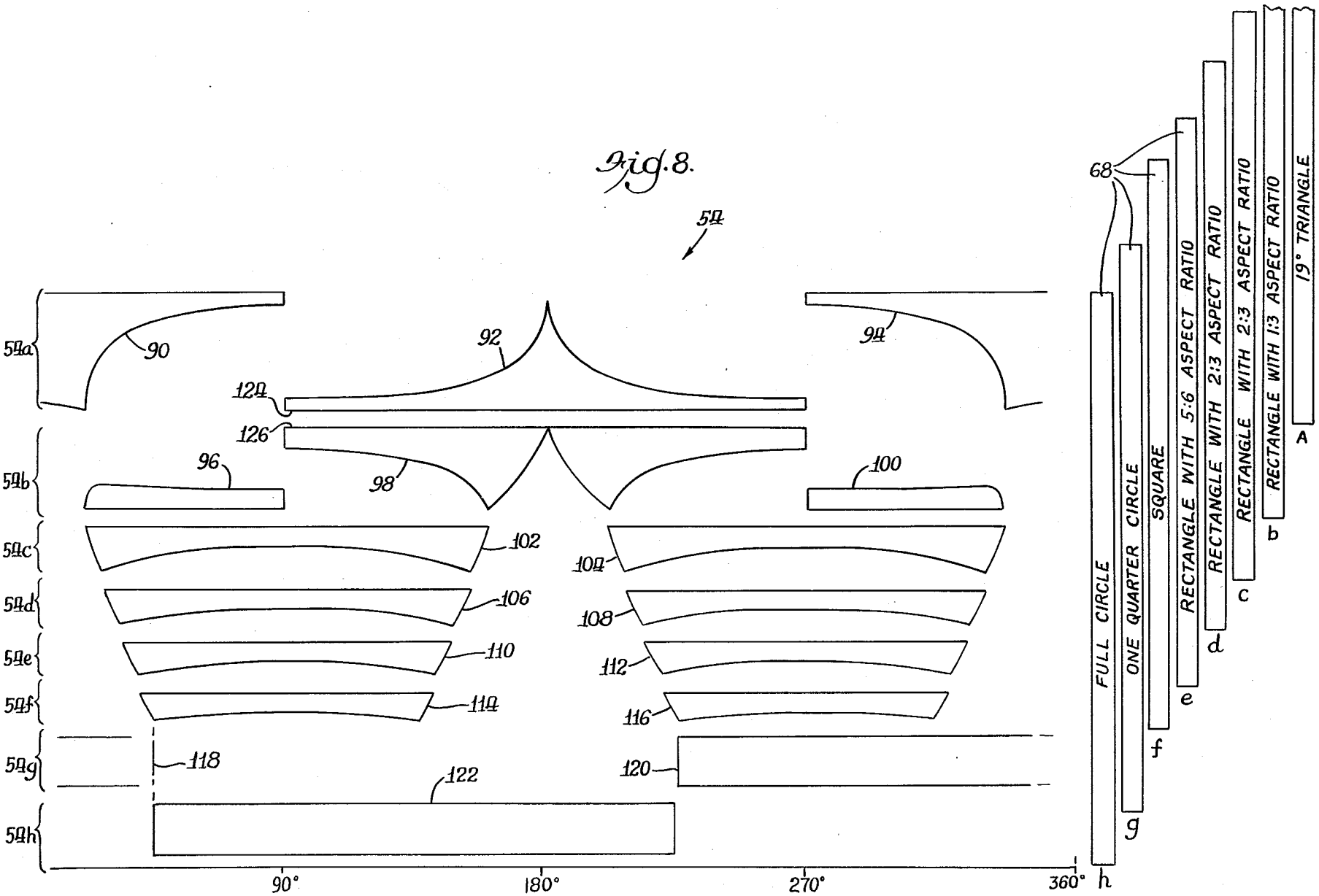
FIG. 8 illustrates, in more detail, exemplary pattern-defining apertures for use in the sprinkler shown in FIG. 5, and the way in which a pattern sampling aperture may communicate with those apertures to develop different patterns of water coverage.

Referring now to FIG. 1, there is shown a pair of apertures 10 and 12 whose function will be briefly described to better understand the principles of the invention. It is assumed that at least one of the apertures 10 and 12 are movable in the X direction so that their mutual area of overlap 14 (the cross-hatched area) is a function of their relative positions. Assuming that the apertures 10 and 12 are situated such that water can flow only through the overlap area 14, it can be appreciated that the rate of flow of water will be dependent on the size of the overlap area 14. Hence, the rate of flow of water will vary as the aperture 10, for example, is moved in the X direction (or in the Y direction for this particular example).

Applying this principle to a water sprinkler, a pair of apertures 16 and 18 are shown in FIG. 2 for generating a rectangular pattern of water coverage. Hereinafter, the aperture 16 is referred to as a pattern-defining aperture because its shape determines the ultimate pattern of water coverage. Also, the aperture 18 is referred to hereinafter as a sampling aperture because it samples successive portions of the aperture 16.

As shown, the pattern-defining aperture 16 extends between zero and 90°, corresponding to similar angles of rotation of a rotatable sprinkler nozzle. Thus, movement of the aperture 18 from zero to 90° corresponds to 90° rotation of a sprinkler nozzle. Of course, a sprinkler nozzle will normally rotate through 360°, but it will be understood that additional apertures 16 may be included to permit sampling throughout 360° of rotation.

If the apertures 16 and 18 are disposed such that water can only flow through an area 20 defined by the overlap between the apertures 16 and 18, then the flow of water through the overlap area 20 will depend on the position of the aperture 18 with respect to the aperture 16. Specifically, when the aperture 18 is located at the zero degrees location, the area 20 will be minimum and the flow of water through the area 20 will be minimum. As the aperture 18 moves to the right, the flow of water will gradually increase to a maximum at the 45° position. Further movement of the aperture 18 to the right will cause the flow of water through the area 20 to gradually decrease to another minimum at the 90° position. Now if the water which passes through the overlap area 20 is conducted to a rotatable outlet nozzle, and the movement of the aperture 18 is synchronized to the rotation of the outlet nozzle, the flow of water from the nozzle will vary with angular positions of the nozzle to develop a water pattern coverage related to the shape or contour of the pattern-defining structure 16.

It can be shown that the pattern-defining aperture 16 will develop a water pattern coverage corresponding to one quadrant of a square. For example, referring to FIG. 3, the aperture 16 will develop a water pattern coverage corresponding to the upper right quadrant of the square 22. That is, if the water outlet nozzle is located at the center 24 of the square 22, synchronous rotation of the outlet nozzle and the sampling aperture 18 between zero degrees and 90° will generate a water pattern coverage corresponding to one quadrant of a square. To develop a water pattern coverage corresponding to a full square, three more pattern-defining apertures, all identical to aperture 16, would be laid side-by-side to the right of aperture 16, and the sampling aperture 18 would sweep across all four pattern-defining apertures in synchronism with 360° rotation of the outlet nozzle. This operation would generate a water pattern coverage corresponding to the square 22.

An advantage in using the type of pattern-defining aperture and sampling aperture depicted in FIG. 2 is that the aspect ratio of the water pattern coverage may be easily changed. For example, if the peak 26 of the aperture 16 is moved to the left to a position corresponding to 38.7°, a rectangular water pattern coverage having an aspect ratio of 4:5 will be obtained. This is shown graphically in FIG. 3 wherein one corner of the 4:5 rectangle occurs at 38.7°. Of course, four such pattern-defining apertures would be used to develop the complete rectangle.

Referring now to FIG. 4, there is shown more explicitly how the pattern-defining aperture 16 may be modified to develop rectangular water pattern coverages of various aspect ratios. Specifically, the aperture 16 has a peak 26 at the 45° location for developing one quadrant of a square pattern of water coverage. The pattern defining aperture 28 has a peak 30 at a location of 38.7° for developing a rectangular water pattern coverage with an aspect ratio of 4:5. The pattern-defining aperture 32 has a peak 34 at approximately 30° for developing a rectangular water pattern coverage having an aspect ratio of 3:5. The pattern-defining aperture 36 has a peak 38 located approximately at 21° for developing a rectangular water pattern coverage having an aspect ratio of 2:5. The pattern-defining apertuure 40 has a peak 42 at approximately 8° for developing a rectangular water pattern coverage having an aspect ratio of 1:5.

If any one of the apertures 16, 28, 32, 36, or 40 is sampled individually as by the sampling aperture of FIG. 2, a rectangular pattern of water coverage of a given aspect ratio is developed. However, the aperture 16 may be segmented as described below for cumulative sampling of apertures.

Specifically, the aperture 16 may be broken down into individual segments A–E as shown, the segment A corresponding to the aperture 40. Thus, when only segment A is sampled, a rectangular pattern of water coverage having an aspect ratio of 1:5 is developed. Similarly, when segments A and B are sampled simultaneously (cumulatively), a rectangular pattern of coverage having an aspect ratio of 2:5 is developed. Similarly, when segments A through E are sampled simultaneously, a rectangular pattern of coverage having an aspect ratio of 5:5 is developed.

The significance of having various aperture segments which may be simultaneously sampled is that those segments may be physically spaced from each other while yet providing a composite pattern coverage when they are sampled simultaneously. In addition, the need for apertures which individually develop the patterns of different aspect ratios is eliminated, since the smaller segments may be sampled cumulatively to develop the same patterns. Hence, less space is required.

The apertures described in the embodiment below are contoured different from those shown in FIG. 4, but they make use of the same principle of sampling segmented apertures to develop not only rectangular patterns of water coverage, but triangular and circular patterns as well.

In the embodiment described immediately below, the pattern-defining apertures are segmented and contoured such that the sampling of one set of apertures develops a triangular pattern of water coverage, and the simultaneous sampling of additional apertures develops a composite pattern of coverage which is rectangular. Simultaneous sampling of yet additional apertures develops a rectangular pattern of water coverage whose aspect ratio is variable, depending on the number of apertures sampled. As a result, the pattern of water coverage can be varied by sampling the outputs of selected apertures or combinations of apertures.

Referring now to FIG. 5, there is shown an exemplary water sprinkler 44 which develops predetermined but variable patterns of water coverage by sampling one or more selected pattern-defining apertures. The sprinkler 44 includes a base section 46 which may be circular and which has a water inlet port 48 disposed internally thereof.

A substantial portion of the water entering the inlet port 48 is constrained to flow through a flow regulator which normally determines the ultimate pattern of water coverage. In the embodiment shown in FIG. 5, the flow regulator includes a revolving sampling aperture in the form of a slit 68 and an upstanding hollow, cylindrical tube 52 integrally formed with the base 46 and having a plurality of pattern-defining apertures 54*a*, 54*b*, 54*c*, etc. The pattern-defining apertures 54 extend circularly around the outer periphery of the tube 52 and are individually contoured, as described in detail below, to develop various patterns of water coverage as the slit 68 revolves around the tube 52.

Disposed above and concentric with the tube 52 is a hollow, cylindrical head 56 whose internal diameter is somewhat larger than the outer diameter of the tube 52, whereby the head 56 may be fitted over the tube 52 concentrically as shown. A clearance (not shown) at an interface 58 between the tube 52 and the head 56 is maintained in order to permit relatively free rotation of the head 56 about the tube 52 and to permit the head 56 to be moved vertically with respect to the tube 52.

To adjust the head 56 to a predetermined vertical position with respect to the tube 52, a circular collar 62 is fitted around the lower portion of the head 56 and is coupled to the base 46 by threads 64. Thus, rotation of the collar 62 moves the latter vertically with respect to the tube 52.

As is described in more detail below, water pressure urges the head 56 upwardly so that a pressure plate 65 on the head 56 abuts a lower edge **62*a* of the collar 62. Accordingly, vertical motion of the collar 62 is followed by corresponding vertical motion of the head 56**.

A small clearance (not shown) is left at the interface 66 between the lower portion of the head 56 and the collar 62, typically about five thousandths of an inch, to permit the head 56 to rotate freely within the collar 62.

Formed in the head 56 is the sampling aperture shown as the slit 68 which is disposed adjacent to and in combination with the apertures 54 in the tube 52. The slit 68 extends in the axial direction of the tube 52 so as to communicate both with a selected number of the apertures 54 as well as with a water conduit 70 located internally of the head 56. The slit 68 may have a width in the direction perpendicular to the plane of FIG. 5 of approximately 0.055 inch and, in any event, has a width which allows the slit 68 to communicate with only a small angular portion of each aperture 54 for any given instant of time.

The slit 68 is moved vertically to communicate only with selected apertures 54 by manually rotating the collar 62 with respect to the base 46. Such rotation causes the collar 62 to rotate in the threads 64 and to move vertically, thereby permitting the head 56 and the slit 68 to move upwardly under water pressure when the collar is rotated in one direction, and forcing the head 56 and the slit 68 downwardly when the collar 62 is rotated in the reverse direction.

To effect rotation of the head 56 and the slit 68, helical vanes 72 are fixed to the internal portion of the head 56 and disposed within the conduit 70 as shown. The vanes 72 are contoured in a conventional helical manner to impart rotational movement of the head 56 under pressure from upwardly moving water from the slit 68 and to permit the water to flow upwardly through the conduit 70.

When water enters the inlet port 48, it passes into the tube 52 and through the apertures 54 which communicate with the slit 68. The water emerges from the slit 68 and enters the conduit 70, whereupon it encounters the vanes 72. The pressure of the water on the vanes 72 rotates the head 56 so that the slit 68 rotates about the apertures 54, the latter of which extend circularly about the tube 52. This rotation enables the slit 68 to communicate with successive portions of the apertures 54 and sample the outputs thereof. Because the contour of each aperture generally varies as a function of its circular extension around the tube 52, the slit 68 passes a varying amount of water as it rotates.

In addition to rotating the head 56, the pressure of water on the vanes 72 also urges the head upwardly so that the pressure plate 65 is forced against the bottom edge **62*a* of the collar 62. Thus, the slit 68 is held at a predetermined vertical position with respect to the apertures 54 and communicates only with selected pattern-defining apertures. Although FIG. 5 illustrates the slit 68 communicating with all the apertures 54, it will be appreciated that rotation of the collar 62 in the correct direction will move the head 56 upwardly. Consequently, the slit 68 may be positioned to communicate with one or more of the apertures 54**.

Disposed at the top of the head 56 is nozzle 74 comprising an outlet port 76, a diffusing port 78, and an auxiliary outlet port 79. As shown, the outlet port 76 communicates with the conduit 70 such that most of the water flowing through the conduit 70 emerges from the outlet port 76.

Situated between the diffusing port 78 and the conduit 70 is a rotatable diffusing wheel 80. As shown more clearly in FIG. 6, the wheel 80 has a pair of S-shaped arms 82 disposed on either side of a central member 84. The peripheral surface of the member 84 is contoured as shown to have a diameter which gradually increases so that, as water impinges on the arms 82, the member 84 rotates on its shaft 86 for opening and closing the diffusing port 78. In operation, the wheel 80 rotates much faster than the head 56 so that the water which is expelled from the diffusing port 78 collides with water from the outlet port 76 so as to evenly distribute water from the sprinkler 44 to the periphery of the water pattern coverage.

FIG. 7 illustrates the relative position of the wheel 80 with respect to the conduit 70. As shown, the shaft 86 may rotate within a pair of bearings 88.

Referring now to the auxiliary port 79, it communicates via an internal conduit 81 with a cavity 83 disposed under the pressure plate 65. In operation, a certain amount of leakage water passes through the apertures 54, into the interface 58 between the head 56 and the tube 52, and enters the cavity 83. Because the water which accumulates in the cavity 83 is under pressure, it rises through the conduit 81 and is expelled from the auxiliary port 79.

Although such leakage and its expulsion is not necessary for the practice of the invention, it is desirable in that it lubricates the interface 58 between the tube 52 and the head 56. Further, a small amount of leakage travels from the cavity 83 upwardly through the interface 66 between the head 56 and the collar 62, thereby lubricating the interface 66 to permit easier rotation of the head 56.

It is apparent that the amount of water exiting the ports 76 and 78 will vary as the slit 68 communicates with the circularly varying contours of the apertures 54. However, the amount of water exiting the port 79 is substantially constant, as is the leakage water from interface 58 into the conduit 70. The total amount of water from the slit 68 and the leakage from interface 58 is yet made to vary so as to develop predetermined patterns of water coverage by dimensioning the apertures 54 so as to take into account the total amount of leakage water. The apertures which are described hereinafter are dimensioned such that the resultant patterns of water coverage are developed from the leakage water from port 79, the leakage from interface 58 directly into the conduit 70 as well as the water passing through the slit 68.

Because the nozzle 74 and the slit 68 are both integral with the head 56, the slit 68 necessarily rotates in synchronism with the nozzle 74. Hence, for each angular position of the nozzle 74 there is a predetermined angular position for the slit 68. Thus, the flow of water from the nozzle 74 is dependent on the angular position of the slit 68 and the countour of the apertures 54 which the slit 68 samples.

Referring now to FIG. 8, exemplary contours of the pattern-defining apertures 54 are shown as well as various vertical positions of the slit 68 for developing various patterns of water coverage. In this figure, the apertures 54 are shown as they would appear if the tube 52 were unfolded and laid flat. To the right of the apertures 54, the slit 68 is shown in various vertical positions wherein it communicates with different apertures 54.

As can be seen, most of the apertures 54 include a plurality or set of apertures. For example, the set 54*a* (corresponding to aperture 54*a* of FIG. 5) comprises apertures 90, 92, and 94 (actually, apertures 90 and 94 are continuous on tube 52). The sets of apertuures 54*b* through 54*f* also each include at least two separate apertures. Only the sets 54*g* and 54*h* include but a single aperture. The reason for using a plurality of apertures in each set of apertures is to avoid using a single, continuous aperture which extends completely around the tube 52. Such a continuous aperture would sever the tube into two parts and make its construction more difficult.

In general, each of the sets of apertures 54*a*–54*h* is contoured to develop a given pattern of water coverage. Moreover, the pattern developed by each set of apertures compliments the pattern developed by an adjacent set of apertures so that a given composite pattern is developed when multiple adjacent sets of apertures are sampled. Such contouring of the sets of aperture 54*a*–54*h* corresponds to the contouring of the apertures 16, 28, 32, 36 and 40 of FIG. 4 in that the latter, when segmented and cumulatively sampled as described hereinbefore, generate a composite pattern of water coverage.

Referring now to the set of apertures 54*a*, it can be seen that the aperture 90 extends around the tube 52 by 90°, the aperture 92 extends from 90° to 270° around the tube, and the aperture 94 extends from 270° to 360° around the tube 52. Thus, as the collar 62 (FIG. 5) is adjusted so that the slit 68 communicates only with the set of apertures 54*a*, rotation of the head 56 will cause the slit 68 to sweep progressively across the apertures 90, 92 and 94. Consequently, the slit 68 samples the outputs of the apertures in the set 54*a* progressively and delivers to the outlet port 76 a flow of water dependent on the contour of the apertures 90, 92 and 94. That is, the water pattern coverage at each angular position of the outlet port 76 is related to the contour of the aperture being sampled by the slit 68.

When the slit 68 is adjusted vertically to the position indicated at A in FIG. 8, it samples only the apertures within the set 54*a*. The apertures in the set 54*a* are contoured as shown so that the resultant pattern of water coverage corresponds to a triangle with the sprinkler at a point midway on the line of symmetry of the triangle. In addition, two of the included angles of the triangle are equal, the third angle being equal to 19°. The apertures 90, 92, and 94 may, of course, be modified to develop other triangular patterns of water coverage.

Referring now to the set 54*b* of apertures 96, 98 and 100, this set of apertures is contoured such that when the slit 68 communicates with the sets of apertures 54*a* and 54*b* simultaneously, a rectangular pattern of water coverage is obtained, the rectangle having an aspect ratio of 1:3. This effect is obtained when the slit 68 is at the position indicated at B in FIG. 8. Thus, the sets of apertures 54*a* and 54*b* individually define different water pattern coverages but their composite effect is that of a rectangle.

The aspect ratio of the rectangular water pattern coverage is varied by moving the slit 68 vertically downward. For example, when the slit 68 is at the position indicated at C, the slit 68 additionally communicates with apertures 102 and 104 in the set 54*c*. In this condition a composite water pattern coverage corresponding to a rectangle having an aspect ratio of 1:2 is obtained.

The set 54*d* of apertures includes apertures 106 and 108 which are contoured such that a rectangular pattern of water coverage with an aspect ratio of 2:3 is obtained when the slit 68 is in the position d. In this position, the slit 68 communicates with all the apertures in the sets 54*a*–54*d*.

The set 54*e* includes apertures 110 and 112 which are contoured such that a rectangular pattern having an aspect ratio 5:6 is obtained when the slit 68 is in position *e*.

When the slit 68 is moved to position f, the apertures 114 and 116 in set 54*f* alter the composite water pattern to that of a square. Further downward movement of the slit 68 brings into play the apertures 118 and 120 in the set 54*g* (apertures 118 and 120 are actually one continuous aperture on tube 52). Their contribution results in a composite pattern of water coverage corresponding to a quarter circle, as indicated at slit position g. The sprinkler itself will be midway on the line of symmetry of the quarter circle.

The set 54*h* includes but a single aperture 122. When the slit 68 is moved to position h, it communicates with the set 54*h* and every other set of apertures to develop a circular pattern of water coverage.

It is noted that the apertures 118, 120 and 122 are rectangular in shape. That is, their contour does not vary as a function of their angular extension around the tube 52. However, the apertures 118, 120 and 122 are sized to permit a flow of water which is great enough so that the size of the water outlet 76 essentially controls the flow of water. That is, the size of the outlet 76 is the limiting factor in the flow of water. Consequently, an arcuate pattern is developed wherever the slit 68 communicates with one of the apertures 118, 120 or 122.

In the embodiment shown in FIG. 8, the apertures are contoured such that progressive upward or downward movement of the slit 68 progressively changes the composite water pattern developed. Accordingly, the slit 68 is made long enough to communicate with all sets of apertures to generate the composite pattern. However, the apertures need not be contoured so as to collectively generate a composite water pattern. For example, the apertures may include a first set 54*a* which develops a triangular water pattern, a second set of apertures vertically spaced from the first set and contoured to develop its own individual water pattern, rectangular for example, and other sets of apertures which are contoured to develop yet another water pattern. In that case, the slit may be made long enough only to communicate with a single set of apertures at one time. To change the pattern of water coverage, the slit would be moved to the appropriate set of apertures. In such an embodiment, there would not necessarily be the cooperation between sets of apertures to develop composite patterns. However, the preferred form is shown in FIG. 8 because many more patterns can be developed by apertures which can be closely stacked on the tube 52, thereby minimizing the length of the latter.

Referring again to FIG. 8, it will be noted that, according to another aspect of the invention, each of the pattern-defining apertures has at least one flat edge. For example, the apertures 92 and 98 have flat edges 124 and 126, respectively. By contouring the apertures to develop their desired pattern while yet having at least one flat edge enables the apertures to be closely stacked as shown, thereby further reducing the required height of the tube 52.

In the discussion above, a given pattern of water coverage was shown to be generated by causing the slit 68 to communicate with or overlap entirely a selected set or sets of apertures. However, the slit 68 may be adjusted to communicate with or overlap only a portion of a selected set or sets of apertures to develop a pattern of water coverage which is slightly different. For example, when the slit 68 is in position d (FIG. 8), it completely overlaps the sets of apertures 54*a*–54*d* to provide a rectangular pattern of water coverage having an aspect ratio of 2:3. However, the slit 68 may be moved upwardly in FIG. 8 so that it completely overlaps the sets of apertures 54*a*–54*c* and overlaps only the upper portions of the apertures in the set 54*d*. The latter position of the slit 68 will result in the development of a water pattern coverage which is generally rectangular but which has an aspect ratio between 2:3 and 1:2. Similar variations in the pattern of water coverage may be obtained by adjusting the slit 68 so that it partially overlaps another set of apertures.

Figure 9:
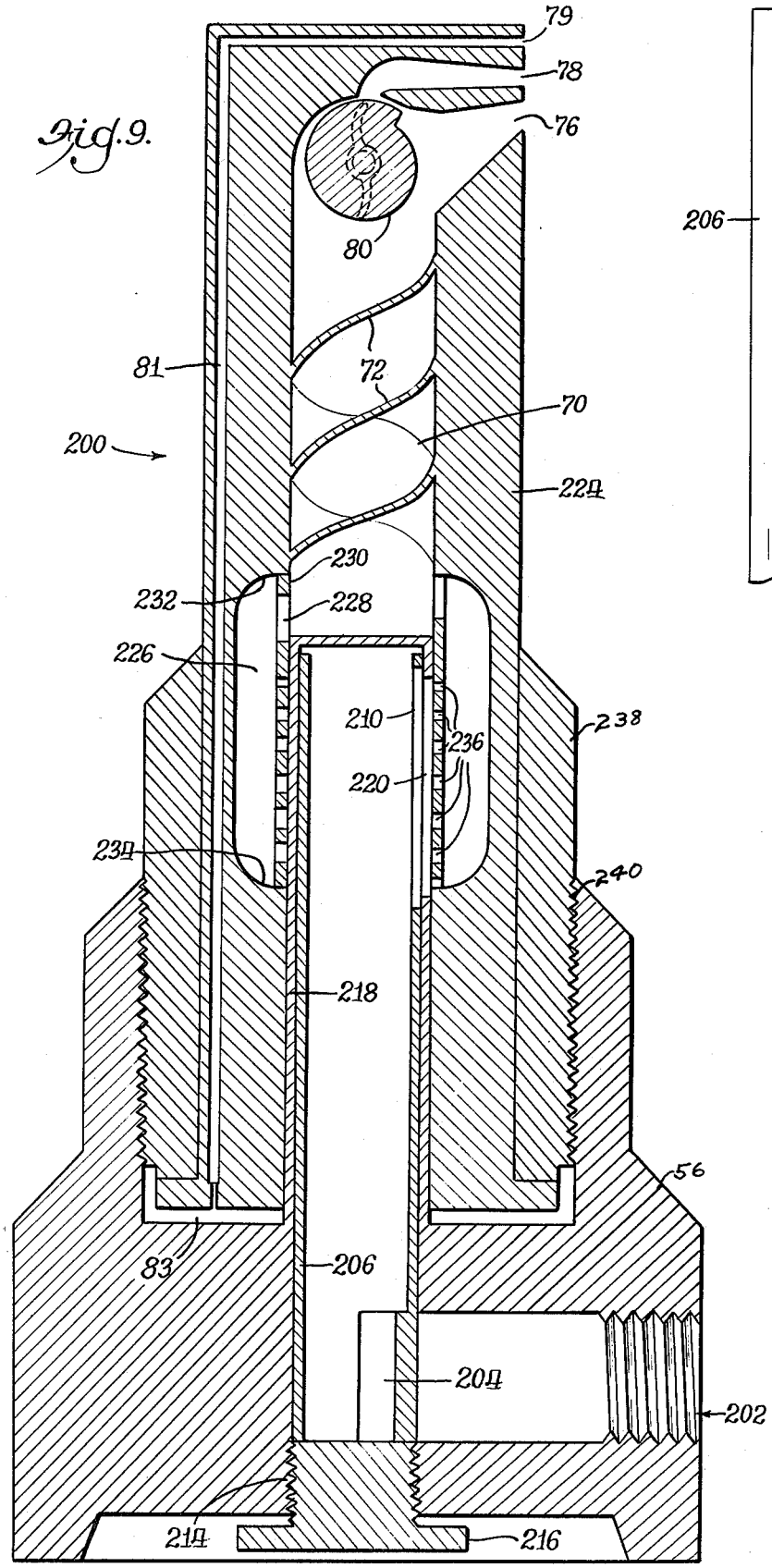
FIG. 9 is a sectional view of another water sprinkler embodying various aspects of the invention.

Another embodiment of a sprinkler is shown in FIG. 9 wherein elements corresponding to those of FIG. 5 are given like reference numerals. The primary differences between the sprinkler shown in FIG. 9 and that shown in FIG. 5 is that, in the FIG. 9 embodiment, the pattern-defining apertures rotate relative to pattern-sampling slits, and an additional aperture is included to vary the size of a pattern of water coverage without substantially changing its configuration. Other differences will be apparent from the discussion below.

Referring now to FIG. 9, the sprinkler 200 is shown as having a base 56 in which an inlet port 202 is bored for receiving water from a water source. Water which enters the port 202 passes through an entrance aperture 204 formed in a hollow, cylindrical tube 206 located internally of the base 56. The top of the tube 56 is substantially sealed off at 208 and by the side wall of the tube 206 to constrain the water to flow through a sampling selector aperture 210 formed in the side wall of the tube 206.

Figure 10:
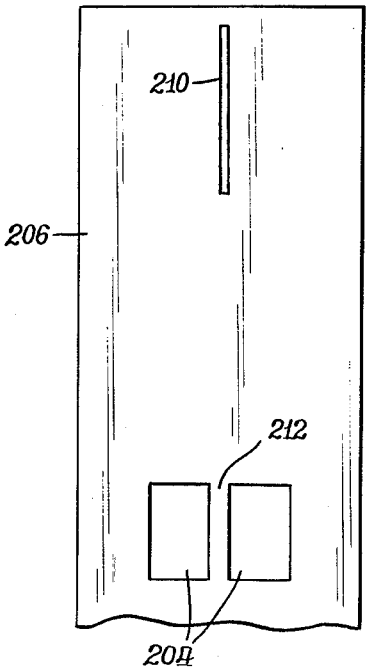
FIG. 10 is an unfolded view of a selector tube used in the sprinkler of FIG. 9.

Referring briefly to FIG. 10, the tube 206 is shown as it would appear if unfolded and lying flat. As can be seen from this Figure, the entrance aperture 204 is split by a support post 212 which is integral to the tube 206 and serves to lend rigidity to the tube 206 in the vicinity of the aperture 240. The sampling selector aperture 210 is shown as preferably being a vertically elongated slit.

Referring again to FIG. 9, the tube 206 is threaded at 214 for engagement with mating threads in the base 56. The bottom of the tube 56 terminates in a knob 216 for manually rotating the tube 206 and its sampling selector aperture 210. As described in more detail below, the tube 206 and its aperture 210 are for constraining the flow of water from the inlet port 202 to flow through a selected one of a plurality of pattern-sampling apertures for selecting the desired size of water pattern coverage.

Surrounding the tube 206 is a pattern sampling means in the form of another hollow tube 218 formed integrally with the base 56. The sidewall of the tube 218 surrounds the sidewall of the tube 206 and is separated therefrom by a small clearance (not shown) to permit relative vertical movement of one tube with respect to the other. The top 208 of the tube 218 covers the tube 206 to constrain the water to flow through the selector slit 210.

Figure 11:
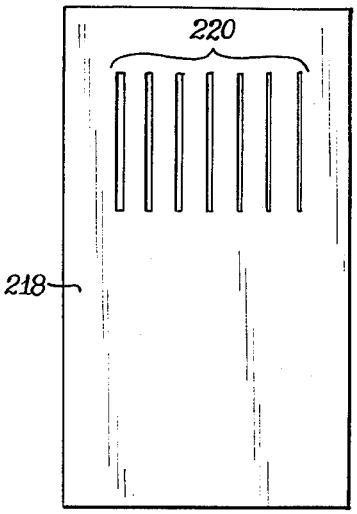
FIG. 11 is an unfolded view of a sampling means and its apertures used in the sprinkler tube of FIG. 9.

The tube 218 further includes a plurality of sampling apertures in the form of elongated, vertically extending slits 220. FIG. 11 shows the tube 218 as it would appear if it were unfolded and more clearly shows the sampling slits 220.

In the embodiment shown, the slits 220 have similar lengths but different widths so that each slit 220 will pass a different amount of water in a given time interval. For example, the rightmost slit 220 is the narrowest slit and the leftmost slit is the widest. The intermediate slits 220 have widths which are progressively greater as viewed from right to left in the Figure.

As will be apparent in the description below of the operation of the sprinkler 200, preferably only one sampling slit 220 is in communication with the selector slit 210 at any given moment, the remaining sampling slits 220 being masked by the side wall of the tube 206.

Referring again to FIG. 9, the sprinkler 200 further includes a rotatable head 224 having an internally bored conduit 81 for passing water from a cavity 83. Internally of the head 224 is a diffusing wheel 80, an exit port 76, a diffusing port 78, and an auxiliary port 79. Functionally, the conduit 81, cavity 83, diffusing wheel 80 and ports 76, 78 and 79 are equivalent to the similarly numbered elements of the FIG. 5 embodiment and are not, therefore, discussed in greater detail.

The head 224 also includes an internal cavity 226 which extends circularly of the head 224 as shown. The cavity 226 communicates with the main outlet conduit 70 via a circularly extending aperture 228 in a web 230.

The web 230 extends vertically from an upper portion 232 of the cavity 226 to a lower portion 234 thereof and surrounds the upper portion of the tube 218.

The web 230 is perforated with at least one and preferably with a plurality of pattern-defining apertures 236 which extend circularly around the web 230 in close proximity with the sampling slits 220. The pattern-defining apertures 236 may be contoured as shown in FIG. 8 and may include a plurality of sets of apertures serving the function previously described with reference to the embodiment of FIG. 5.

In the embodiment of FIG. 9, however, the apertures 236 rotate with the head 234 so that they may be progressively sampled by one of the slits 220.

To place different apertures 236 in communication with a slit 220, a circular collar 238 is closely fitted to the head 224 and threaded to the base 56 by threads 240. By manually rotating the collar 238, the collar, the head 224, and the pattern-sampling apertures 236 are moved vertically with respect to the slits 220 so that selected apertures 236 communicate with a slit 220.

In operation, water which is introduced into the inlet port 202 flows upwardly into the tube 206. Assuming that the knob 216 has been rotated such that the selector slit 210 is aligned with one of the sampling slits 220, water flows through the selector slit 210 and through the sampling slit 220 which is aligned with the selector slit 210.

Water exiting a sampling slit 220 passes through those pattern-sampling apertures 236 which are in communication with the selected sampling slit 220.

After passing through one or more pattern-sampling apertures 236, the water flows into the cavity 226, through the aperture 228, and upwardly into the conduit 70. As the water impinges on the vanes 72 on its way to the outlet port 76, the pressure of the water on the vanes 72 causes the head 224 to rotate.

As the head 224 rotates, the pattern-sampling apertures 236 rotate about the selected sampling slit 220, whereby the latter samples progressive circular portions of the apertures 236 to generate a pattern of water coverage related to the configuration of the apertures 236. This generation of a water pattern coverage is like that described above with reference to the embodiment of FIG. 5.

To select a different pattern of water coverage, the collar 238 is manually rotated to bring other pattern-defining apertures into communication with the selected sampling slit 220, all as described above.

In order to vary the size of the water pattern coverage without substantially changing its configuration, the knob 216 is manually rotated to bring the selector slit 210 into alignment with a different sampling slit 220. Now water flows through the selector slit 210 and the newly aligned sampling slit 220, and through the pattern-defining apertures 236 which are vertically oriented to communicate with that aligned sampling slit 220.

From the discussion above, it will be appreciated that the embodiment of FIG. 9 produces the same patterns of water coverage as the FIG. 5 embodiment while further permitting easy manual adjustment of the size of the water patterns.

The embodiments described above provide a number of advantages not generally found in prior sprinklers, particularly the ability to conform the pattern of water coverage to a selected area to be sprinkled. Thus, the amount of water used is minimized. Further, the pattern of water coverage is easily varied without disassembling the sprinkler.

An additional advantage is that the pattern of water coverage may be adjusted without requiring an operator to avoid the output of the sprinkler. For example, if a rectangular pattern of a given aspect ratio is desired, one may position the sprinkler midway on a line of symmetry of the area to be sprinkled, position oneself behind the line of symmetry (opposite the nozzle), and adjust the collar 66 and/or the knob 216 (in the FIG. 9 embodiment) to produce one-half the pattern, i.e., the pattern which lies in front of the operator. The pattern generated can be "fine tuned" by manually rotating the sprinkler head back to a starting position, readjusting the collar 66 and/or the knob 216, and releasing the sprinkler head to allow the sprinkler to re-define the half pattern again. Once the desired half pattern has been obtained, the operator may release the sprinkler head and allow it to rotate fully to define a pattern through 360° of rotation, including the second half of the pattern which was behind the operator when adjustments were being made. Because the second half of the pattern will be symmetrical with respect to the first half of the pattern, the over-all pattern will have been adjusted without requiring an operator to dodge the spray while adjusting the sprinkler.

Although an exemplary structure and aperture contours have been illustrated, the invention may be practiced using alternate structure and aperture contours. For example, the aperture contours shown in FIG. 8 may be modified to generate a large variety of patterns. Moreover, they may be "customized" to develop water patterns corresponding to irregularly shaped yards.

Further, a sprinkler according to this invention is not limited to a single sampling slit having relative rotation with respect to a set of apertures which extend completely around a tube. For example, in the FIG. 5 embodiment, a pair of oppositely disposed slits may be used in connection with pattern-defining apertures which extend only half way around the tube. Moreover, the pattern sampling aperture need not be in the form of a slit. Rather, it may take any appropriate form which allows it to cooperate with circularly extending, pattern-defining apertures so as to integrate the contour of the pattern-defining apertures to develop a desired pattern and coverage.

Many other modifications and alterations will be apparent to those skilled in the art in light of this disclosure. Accordingly, it is intended that all such modifications and alterations be included within the spirit and scope of the invention as defined by the appended claims.

What is claimed is:

1. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regulator including:

means defining a plurality of vertically spaced, circularly extending, pattern-defining apertures for passing a flow of water therethrough, a first of said pattern-defining apertures being contoured to develop a first pattern of water coverage, and at least a second of said pattern-defining apertures being contoured to develop, in combination with said first pattern-defining aperture, a second composite pattern of water coverage, and sampling means defining at least one pattern-sampling aperture contoured to permit simultaneous communication with a plurality of said pattern-defining apertures, said pattern-defining apertures and said sampling aperture being disposed such that at least a substantial portion of the water from said inlet port is constrained to flow through at least a selected one of said pattern-defining apertures and said sampling aperture in route to said outlet port;

means for effecting relative motion between said pattern-sampling apertures and said pattern-defining aperture to sample successive portions of said selected pattern-defining apertures in synchronism with the rotation of said outlet port; and vertically movable pattern selection means for modifying the pattern of water coverage from a condition wherein water from the inlet port flows through said pattern-sampling aperture and said first pattern-defining aperture to a condition wherein water flows from the inlet port through said pattern-sampling aperture and said first and second pattern-defining apertures, whereby the sampling of successive portions of said selected pattern-defining apertures by said sampling aperture causes the flow of water from the exit port to develop a water pattern coverage related to the patterns of said selected pattern-defining apertures, and the pattern of water coverage is variable between the first pattern and the second composite pattern.

2. A water sprinkler as set forth in claim 1 wherein said aperture defining means defines a plurality of pattern-defining apertures contoured to develop a water pattern coverage corresponding to a triangle.

3. A water sprinkler as set forth in claim 1 wherein said aperture defining means defines a plurality of pattern-defining apertures contoured to develop a water pattern coverage corresponding to less than a full circle.

4. A water sprinkler as set forth in claim 1 wherein said aperture defining means defines a plurality of pattern-defining apertures contoured to develop a water pattern coverage corresponding to a rectangle.

5. A water sprinkler as set forth in claim 1 wherein said aperture defining means includes a cylindrical tube having a plurality of pattern-defining apertures formed circumferentially therein, and the pattern-sampling aperture of said sampling means is a slit adjacent to and extending in the axial direction of said tube.

6. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regular including:

means defining at least one circularly extending, pattern-defining aperture for passing a selected flow of water therethrough; and sampling means defining a plurality of circularly spaced, pattern-sampling apertures communicating with the pattern-defining aperture, each of said plurality of pattern-sampling apertures being contoured to pass different amounts of water, said pattern-defining aperture and said sampling apertures being disposed such that at least a substantial portion of the water from said inlet port is constrained to flow through said pattern-defining aperture and a selected one of said sampling apertures in route to said outlet port;

means for constraining the flow of water from said inlet port to flow through a selected one of said pattern-sampling apertures; and means for effecting relative motion between said pattern-sampling apertures and said pattern-defining aperture to sample successive portions of said pattern-defining aperture in synchronism with the rotation of said outlet port, whereby the sampling of successive portions of said pattern-defining aperture by said selected sampling aperture causes the flow of water from the exit port to develop a water pattern coverage related to the pattern of said pattern-defining aperture, and the size of the pattern of water coverage is selected by said constraining means causing the water to flow through a sampling aperture of a given size.

7. A water sprinkler as set forth in claim 6 wherein said constraining means defines a circularly movable sampling selector aperture, and including means for moving said sampling selector aperture to communicate with a selected one of said sampling apertures.

8. A water sprinkler as set forth in claim 7 wherein said pattern-defining aperture is revolved around said pattern-sampling apertures such that the selected sampling aperture samples successive portions of said pattern-defining aperture.

9. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regulator including:

means defining a first set of circularly extending, pattern-defining apertures contoured to develop a given water pattern coverage and at least a second set of circularly extending, pattern-defining apertures, the second set of apertures being vertically displaced from the first set of apertures, and vertically fixed sampling means defining at least one pattern-sampling apertured contoured to permit its communication with the pattern-defining apertures, said pattern-defining apertures and said sampling aperture being disposed such that at least a substantial portion of the water from said inlet port is constrained to flow through selected pattern-defining apertures and said sampling aperture in route to said outlet port, said aperture-defining means being vertically displaceable to cause said first set of pattern-defining apertures to communicate with said pattern-sampling aperture to develop a first water pattern coverage and to cause both said first and second sets of pattern-defining apertures to simultaneously communicate with said pattern-sampling apertures to develop a second predetermined water pattern coverage, and means for effecting relative motion between said pattern-sampling aperture and said pattern-defining apertures to sample successive portions of said pattern-defining apertures in synchronism with the rotation of said outlet port, whereby the sampling of successive portions of said pattern-defining apertures by said sampling aperture causes the flow of water from the exit port to develop a water pattern coverage related to the pattern of said pattern-defining apertures.

10. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regulator including:

means defining a plurality of sets of circularly extending pattern-defining apertures for passing a selected flow of water therethrough, each set of such apertures being vertically spaced from adjacent sets of apertures, and sampling means defining at least one pattern-sampling apertured contoured to permit its communication with the pattern-defining apertures, said pattern-defining apertures and said sampling aperture being disposed such that at least a substantial portion of the water from said inlet port is constrained to flow through selected pattern-defining apertures and said sampling aperture in route to said outlet port, said aperture-defining means being vertically displaceable so as to cause selected, adjacent, vertically spaced sets of pattern-defining apertures to communicate with said pattern-sampling aperture, and said pattern-defining apertures being contoured to develop a first given water pattern coverage when a first plurality of sets of pattern-defining apertures communicates with said pattern-sampling aperture and to develop a second given water pattern coverage when a second plurality of sets of pattern-defining apertures communicates with said pattern-sampling aperture, and means for effecting relative motion between said pattern-sampling aperture and said pattern-defining apertures to sample successive portions of said selected pattern-defining apertures in synchronism with the rotation of said outlet port, whereby the sampling of successive portions of said selected pattern-defining apertures by said sampling aperture causes the flow of water from the exit port to develop a water pattern coverage related to the pattern of said selected pattern-defining apertures.

11. A water sprinkler as set forth in claim 10 wherein said pattern-defining apertures are contoured such that a rectangular water pattern coverage of a first aspect ratio is developed when a first plurality of sets of pattern-defining apertures communicates with said pattern-sampling aperture, and a rectangular water pattern coverage of a second aspect ratio is developed when said aperture-defining means is vertically displaced to cause additional sets of pattern-defining apertures to communicate with said pattern-sampling aperture.

12. A water sprinkler for distributing water in a variety of selectable, predetermined patterns, comprising:

an inlet port for receiving water;

a rotatable outlet port;

a hollow, cylindrical tube having a vertically elongated selector slit therein for receiving water from said inlet port and for passing water therethrough, pattern-sampling means defining a plurality of circularly spaced, vertically elongated sampling slits disposed around said tube, each of said sampling slits being contoured to pass different amounts of water;

means for effecting relative rotational movement between said tube and said pattern-sampling means such that said selector slit communicates with a selected sampling slit;

rotatable pattern-defining means defining a plurality of vertically spaced sets of pattern-defining apertures extending around said pattern-sampling means for passing water from said selected sampling slit to said outlet port, said pattern-sampling apertures being contoured such that selected adjacent sets of pattern-sampling apertures together define a composite water pattern of a desired coverage;

means for rotating said pattern-defining means relative to said selected sampling slit for sampling successive portions of pattern-sampling apertures in synchronism with the rotation of said outlet port; and means for effecting relative vertical displacement of said sampling slits with respect to said pattern-defining apertures such that said selected sampling slit communicates with said selected sets of pattern-defining apertures, whereby the sampling by said selected slit of successive portions of apertures in said selected sets of pattern-defining apertures causes the flow of water from the exit port to develop a composite water pattern coverage related to the pattern of the sampled apertures, and the size of the composite water pattern coverage is changed by effecting relative rotational movement between said tube and said pattern-sampling means such that said selector slit communicates with a different sampling slit.

13. A water sprinkler as set forth in claim 12 wherein said pattern-defining means is rotatable by water pressure.

14. A water sprinkler as set forth in claim 12 wherein said tube includes means for its manual rotation with respect to said pattern-sampling means.

15. A water sprinkler as set forth in claim 12 wherein said means for effective relative vertical displacement of said sampling slits with respect to said pattern-defining apertures includes means for manually moving said pattern-defining apertures vertically.

16. A water sprinkler as set forth in claim 12 further including a diffusing nozzle rotatable in synchronism with said outlet port and receiving water intermittently from said pattern-defining apertures, said nozzle being adapted to expel water which collides with water from said outlet port so as to substantially evenly distribute water from the sprinkler to the periphery of water pattern coverage.

17. A water sprinkler as set forth in claim 5 wherein said slit is revolved around the pattern-defining apertures for sampling successive portions thereof.

18. A water sprinkler as set forth in claim 1 wherein said aperture-defining means is stationary, said sampling means is rotated with respect to said aperture-defining means, and said outlet port and said sampling means are rotated synchronously in response to water pressure.

19. A water sprinkler as set forth in claim 1 further including a diffusing nozzle rotatable in synchronism with said outlet port and receiving water intermittently from said sampling aperture, said nozzle being adapted to expel water which collides with water from said outlet port so as to substantially evenly distribute water from the sprinkler to the periphery of the water pattern coverage.

20. A water sprinkler as set forth in claim 19 including a diffusing wheel located closely adjacent said nozzle, said wheel being rotatable in response to the flow of water toward said outlet port and having a peripheral surface contoured to intermittently open and gradually close said nozzle as the wheel rotates.

21. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regulator including:

a cylindrical tube for passing a selected flow of water therethrough, said tube having a first set of circularly extending, pattern-defining apertures contoured to develop a given water pressure coverage and at least a second set of circularly extending, pattern-defining apertures, the second set of apertures being vertically displaced on said tube from the first set of apertures, and sampling means defining at least one pattern-sampling aperture contoured to permit its communication with the pattern-defining apertures, said pattern-defining apertures and said sampling aperture being disposed such that at least a substantial portion of the water from said inlet port is constrained to flow through selected pattern-defining apertures and said sampling aperture in route to said outlet port, said sampling means being vertically displaceable to communicate with said first set of apertures to develop a first water pattern coverage and to communicate with both said first and second sets of apertures simultaneously to develop a second predetermined water pattern coverage, and means for effecting relative motion between said pattern-sampling aperture and said pattern-defining apertures to sample successive portions of selected pattern-defining apertures in synchronism with the rotation of said outlet port, whereby the sampling of successive portions of the selected pattern-defining apertures by said sampling aperture causes the flow of water from the exit port to develop a water pattern coverage related to the pattern of the selected pattern-defining apertures.

22. A water sprinkler as set forth in claim 21 wherein a majority of the apertures in said sets of apertures are contoured to have at least one flat, horizontally extending edge to facilitate close spacing between sets of apertures.

23. A water sprinkler for distributing water in a predetermined pattern, comprising:

an inlet port for receiving water;

a rotatable outlet port;

a flow regulator disposed to receive water from said inlet port and pass a regulated flow of water to said outlet port, said flow regulator including:

a hollow cylindrical member for passing a selected flow of water therethrough and having a plurality of sets of circularly extending, pattern-defining apertures, each set of such apertures being vertically spaced from adjacent sets of apertures, and sampling means defining at least one pattern-sampling aperture contoured to permit its communication with the pattern-defining apertures, said pattern-defining apertures and said sampling aperture being disposed such that at least a substantial portion of the water from said inlet port is constrained to flow through selected pattern-defining apertures and said sampling aperture in route to said outlet port, said pattern-sampling aperture being vertically displaceable so as to communicate with selected, adjacent, vertically spaced sets of pattern-defining apertures, and said pattern-defining apertures being contoured to develop a first given water pattern coverage when said pattern-sampling aperture communicates with a first plurality of sets of pattern-defining apertures and to develop a second given water pattern coverage when said pattern-sampling aperture communicates with a second plurality of sets of

24. A water sprinkler as set forth in claim 23 wherein said pattern-defining apertures are contoured such that a rectangular water pattern coverage of a first aspect ratio is developed when said pattern-sampling aperture communicates with a first plurality of sets of pattern-defining apertures, and a rectangular water pattern coverage of a second aspect ratio is developed when said pattern-sampling aperture is vertically displaced to communicate with additional sets of pattern-defining apertures.

25. A water sprinkler as set forth in claim 21 wherein at least some of said pattern-defining apertures are contoured to develop a water pattern coverage corresponding to less than a full circle.

26. A water sprinkler as set forth in claim 21 wherein at least one set of pattern-defining apertures is contoured to develop a water pattern coverage corresponding to a rectangle.

27. A water sprinkler as set forth in claim 21 wherein at least some of said pattern-defining apertures are contoured to develop a water pattern coverage corresponding to a triangle.

28. A water sprinkler as set forth in claim 21 further including a diffusing nozzle rotatable in synchronism with said outlet port and receiving water intermittently from said sampling aperture, said nozzle being adapted to expel water which collides with water from said outlet port so as to substantially evenly distribute water from said outlet port from the sprinkler to the periphery of the water pattern coverage.

29. A water sprinkler for distributing water in a variety of selectable, predetermined patterns, comprising:

an inlet port for receiving water;

a rotatable outlet port;

a hollow, cylindrical tube disposed to receive water from said inlet port and having a plurality of vertically displaced sets of pattern-defining apertures for passing water from the interior of said tube to the exterior thereof, said apertures being contoured such that selected adjacent sets of apertures together define a composite water pattern of a desired coverage;

rotatable sampling means defining a slit communicating with the pattern-defining apertures for passing water which emerges from said pattern-defining apertures to said outlet port;

means for rotating said slit relative to said pattern-defining apertures for sampling successive portions thereof in synchronism with the rotation of said outlet port; and means for effecting relative vertical displacement of said slit with respect to said pattern-defining apertures such that said slit communicates with said selected sets of pattern-defining apertures, whereby the sampling by said slit of successive portions of apertures in said selected sets of pattern-defining apertures causes the flow of water from the exit port to develop a composite water pattern coverage related to the pattern of the sampled apertures.

30. A water sprinkler as set forth in claim 29 wherein said slit is rotated about said pattern-defining apertures.

31. A water sprinkler as set forth in claim 30 further including a diffusing nozzle rotatable in synchronism with said outlet port and receiving water intermittently from said slit, said nozzle being adapted to expel water which collides with water from said outlet port so as to substantially evenly distribute water from said outlet port from the sprinkler to the periphery of water pattern coverage.

32. A water sprinkler as set forth in claim 29 wherein said cylindrical tube has a plurality of sets of circularly extending, pattern-defining apertures, each set of such apertures being vertically spaced from adjacent sets of apertures, wherein said slit is vertically displaceable so as to communicate with selected adjacent, vertically spaced sets of apertures, and wherein said apertures are contoured to develop a first given water pattern coverage when said slit communicates with a first plurality of sets of apertures and to develop a second given water pattern coverage when said slit communicates with additional sets of apertures.

33. A water sprinkler as set forth in claim 32 wherein said pattern-defining apertures are contoured such that a rectangular water pattern coverage of a first aspect ratio is developed when said slit communicates with a first plurality of sets of apertures and a rectangular water pattern coverage of a second aspect ratio is developed when said slit is vertically displaced to communicate with additional sets of apertures.

34. A water sprinkler as set forth in claim 32 wherein a majority of the apertures in said sets of apertures are contoured to have at least one flat, horizontally extending edge to facilitate close spacing between sets of apertures.

* * * * *

UNITED STATES PATENT OFFICE
CERTIFICATE OF CORRECTION

PATENT NO. : 4,180,210

DATED : December 25, 1979

INVENTOR(S) : Robert E. DeWitt

It is certified that error appears in the above-identified patent and that said Letters Patent are hereby corrected as shown below:

Column 7, line 9, "countour" should be -- contour --

Column 17 (Claim 23), line 56, after "sets of" insert -- pattern-defining apertures; and means for effecting relative motion between said pattern-sampling aperture and said pattern-defining apertures to sample successive portions of the selected pattern-defining apertures in synchronism with the rotation of said outlet port, whereby the sampling of successive portions of selected pattern-defining apertures by said sampling aperture causes the flow of water from the exit port to develop a water pattern coverage related to the pattern of the selected pattern-defining apertures. --

Signed and Sealed this

*First* Day of *April 1980*

[SEAL]

*Attest:*

SIDNEY A. DIAMOND

*Attesting Officer*

*Commissioner of Patents and Trademarks*